United States Patent [19]

Cheadle et al.

[11] 4,452,648

[45] Jun. 5, 1984

[54] LOW IN REACTOR CREEP ZR-BASE ALLOY TUBES

[75] Inventors: Brian A. Cheadle; Richard A. Holt, both of Deep River, Canada

[73] Assignee: Atomic Energy of Canada Limited, Ottawa, Canada

[21] Appl. No.: 278,824

[22] Filed: Jun. 29, 1981

[30] Foreign Application Priority Data

Jul. 8, 1980 [CA] Canada ..... 335707

[51] Int. Cl.[3] ..... C22F 1/18

[52] U.S. Cl. ..... 148/11.5 F; 148/12.7 B

[58] Field of Search ..... 148/11.5 F, 12.7 B, 148/133; 75/177

[56] References Cited

U.S. PATENT DOCUMENTS

| | | | |
|---|---|---|---|
| 3,567,522 | 3/1971 | Thomas et al. | 148/133 |
| 4,000,013 | 12/1976 | MacEwen et al. | 148/133 |
| 4,065,328 | 12/1977 | Cheadle | 148/32.5 |
| 4,212,686 | 7/1980 | Lunde et al. | 148/133 |

OTHER PUBLICATIONS

Williams et al., "Development of High Strength Zirconium Alloys", Canadian Metallurgical Quarterly, vol. 11, No. 1, 1972 (pp. 257–271).

Ibrahim et al., "Creep and Stress-Rupture of High Strength Zirconium Alloys", Canadian Metallurgical Quarterly, vol. 11, No. 1, (1972), pp. 273–283.

Cheadle et al., "Development of texture and structure in Zr–2.5 wt. %, Nb extruded tubes", Canadian Metallurgical Quarterly, vol. 11, No. 1, 1972, pp. 121–127.

Ells et al., "The Irradiation Response of a Group of Complex Zirconium Alloys", Proceedings British Nuclear Energy Society, London, Nov. 9–10, 1972, pp. 43–46.

Kangilaski, "Metallurgy of Common Cladding Materials", Reactor Materials, vol. 13, No. 1, Spring 1970, pp. 1–7.

*Primary Examiner*—Peter K. Skiff

*Attorney, Agent, or Firm*—Richard J. Hicks; Stanley E. Johnson

[57] ABSTRACT

A process for fabricating tubes from a quaternary 3.5% Sn, 1% Mo, 1% Nb balance Zr alloy by hot extrusion, cold working and heat treatment so that the tubes have small grains that have low dislocation densities. The tubes are superior to the standard cold worked Zr-2.5 wt % Nb tubes because during service in CANDU-PHW reactors they (a) have lower axial elongation and diametral expansion and (b) the hydrides are less susceptible to reorientation from the circumferential-axial plane into the radial-axial plane.

6 Claims, 6 Drawing Figures

FIGURE 2: THE FABRICATION ROUTES FOR THE EXCEL TUBES

PREHEAT MACHINED HOLLOW BILLETS TO 1000-1150°K AND EXTRUDE AT A RATIO BETWEEN 4:1 AND 15:1 INTO A TUBE

↓

COLD WORK

↓

ANNEAL AT 950-1100°K

↓

STRESS RELIEVED AT 650-800°K

FIGURE 1

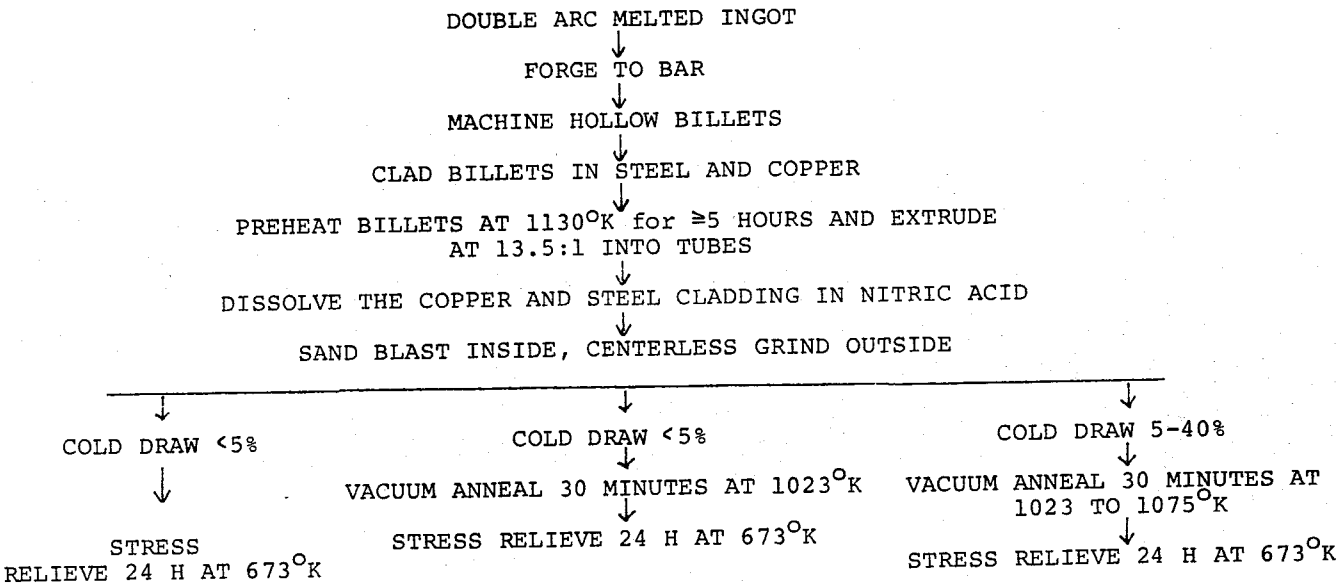
FIGURE 2: THE FABRICATION ROUTES FOR THE EXCEL TUBES 11,500 X

"As-extruded" tubes, elongated α grains and grain boundary network of β phase 11,500 X Annealed tubes, equiaxed α grains and β phase

TYPICAL TRANSMISSION ELECTRON MICROGRAPHS OF THE EXCEL TUBES

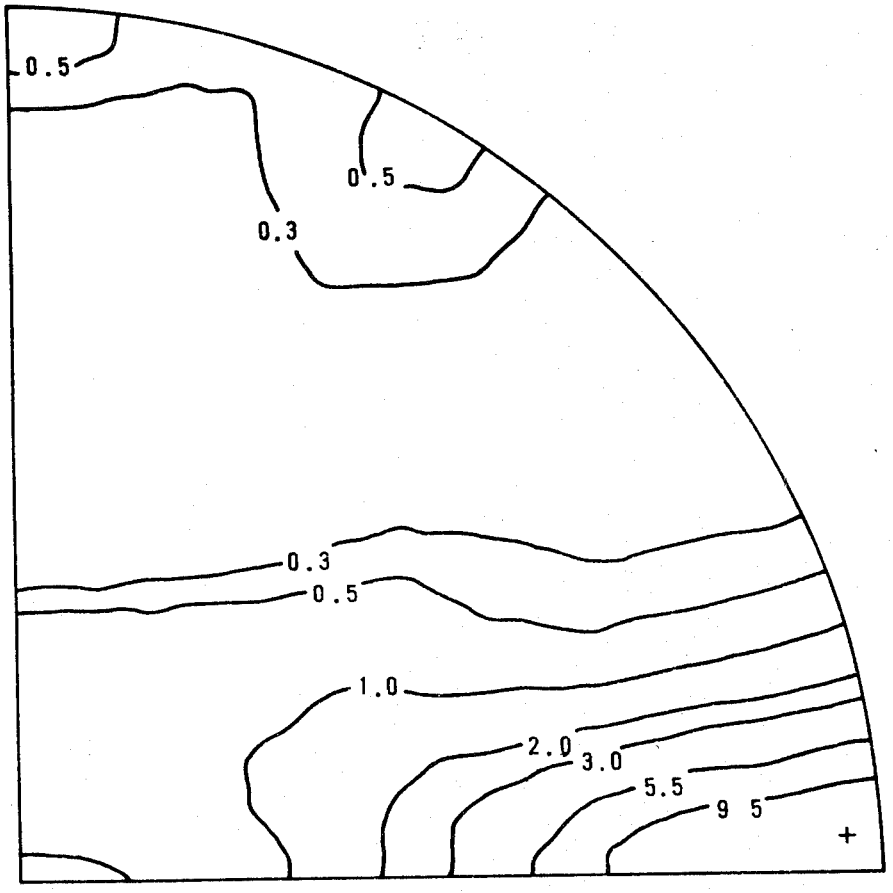
FIGURE 4: AVERAGE (0002) POLE FIGURE FOR THE SEVEN 'EXCEL' ALLOY TUBES

LOW IN REACTOR CREEP ZR-BASE ALLOY TUBES

This invention relates to zirconium alloy tubes especially for use in nuclear power reactors. More particularly this invention relates to quaternary 3.5% Sn, 1% Mo, 1% Nb, balance Zr alloy tubes which have been extruded, cold worked and heat treated to lower their dislocation density. In one preferred embodiment the alloys are cold worked less than 5% and stress relieved to produce a low dislocation density and in another embodiment the alloys are cold worked up to about 50% and annealed to produce a very low dislocation density and also small equiaxed $\alpha$ grains.

Conventionally, pressure tubes for CANDU-PHW type nuclear reactors (*Can*ada-*D*euterium-*U*ranium-*P*ressurized *H*eavy *W*ater) are fabricated by extrusion of Zr-2.5 wt.%Nb billets, followed by cold working and age hardening. Other Zr alloys can also be used for tubing in CANDU-PHW type reactors, such as Zircaloy-2 and quaternary alloys containing 3.5% Sn, 1% Mo, 1% Nb, balance Zr, which provide high strength, low neutron capture cross section and reasonable corrosion resistance. The heat treatment of the quaternary alloys above is described in the literature, and attention is particularly directed to U.S. Pat. No. 4,065,328 to Brian A. Cheadle, issued Dec. 27, 1977 which describes a process for heat treating the quaternary alloys noted above and hereinafter referred to as EXCEL alloys, to produce a duplex micro-structure comprising primary $\alpha$-phase and a complex acicular grain boundary phase. The object of the invention described in the aforesaid U.S. patent is to provide an alloy having maximum possible strength which is achieved by cold working to about 25% followed by age hardening but at the expense of increasing the dislocation density as well. Although such heat treated tubes have relatively good out-of-reactor creep strength, their in-reactor creep strength is adversely affected by the high dislocation density.

Unless otherwise stated all alloy percentages in this specification are percentages by weight.

In CANDU reactors it is desirable for the pressure tubes to have as low axial elongation and diametral expansion as possible during service. While it is possible to reduce elongation and expansion levels in conventional 30% cold worked Zr-2.5% Nb pressure tubes by lowering their dislocation density and making their grains more equiaxed, this, however, also results in a lowering of the tensile strength which would then necessitate increasing the wall thickness with a consequent reduction in reactor efficiency. It is, therefore, necessary to consider the use of one of the alternative alloys referred to above. EXCEL is a stronger and more creep resistant alloy both in and out of reactor than Zr-2.5% Nb, and it has been found that pressure tubes having similar strength to 30% cold worked Zr-2.5% Nb tubes can be fabricated with less than 5% cold work followed by stress relieving at a temperature in the range 650°-800° K. Similarly it has been found that low dislocation density EXCEL alloys can also be produced by cold working up to about 50% followed by annealing at a selected temperature in the range 900°-1100° K.

Thus it is an object of the present invention to provide a process for heat treating and cold working EXCEL alloys, such that they have a minimum ultimate tensile strength of 479 MPa, and during service equivalent to 30 years in a CANDU-PHW 600 MW reactor they have a maximum axial elongation of about 1.5%, and a maximum diametral expansion of 2.5%.

It is another object of this invention to provide a heat treated and cold worked product consisting essentially of Sn 2.5-4.0%, Mo 0.5-1.5%, Nb 0.5-1.5%, 0 800-1300 ppm, balance Zr and incidental impurities, said product having a minimum ultimate tensile strength of 479 MPa, a maximum axial elongation less than 1.5% and a maximum diametral expansion less than 2.5% under conditions equivalent to 30 years service in a CANDU-PHW 600 MW reactor.

For the purposes of the present specification a 600 MW CANDU-PHW reactor is considered to operate at a temperature of 565° K., with a peak neutron flux of $3.85\times10^{17}$ n/(m$^2$·s) an average fast neutron flux along the length of the tube being $2.4\times10^{17}\cdot m^{-2}$, and at a mean coolant pressure of 10.6 MPa. In 30 years service the operational time is estimated at 210,000 hours.

Thus, by one aspect of this invention there is provided a method of fabricating an extruded product from an alloy consisting essentially of Sn 2.5-4%, Mo 0.5-1.5%, Nb 0.5-1.5%, 0 800-1300 ppm balance Zr and incidental impurities wherein a billet of said alloy is preheated in the temperature range 900°-1200° K. and extruded into said product, and said extruded product is cold worked, by an amount up to about 50%, and heat treated at a selected temperature in the range 650°-1100° K., so as to have a dislocation density of less than about $5\times10^{14}$ m$^{-2}$ a minimum U.T.S. of 479 MPa, a maximum axial elongation less than 1.5% and a maximum diametral expansion less than 2.5% under conditions equivalent to 30 years service in a CANDU-PHW 600 MW reactor.

By another aspect of this invention there is provided a heat treated and cold worked alloy for use in nuclear reactor tubes and other extruded products and consisting essentially of Sn 2.5-4.0%, Mo 0.5-1.5% 0 800-1300 ppm, balance Zr and incidental impurities, having a minimum ultimate tensile strength of 479 MPa, a maximum in-service axial elongation of 1.5% and preferably in the range 0.5-0.8%, a maximum in-service diametral expansion of 2.5% and preferably in the range 1.1 to 1.4% and an equiaxed grain structure.

The invention will be described in more detail hereinafter with reference to the accompanying drawings in which:

FIG. 1 is a flow chart of a general fabrication route for alloys of the present invention;

FIG. 2 is a flow chart of a specific fabrication route for alloys according to one aspect of the present invention;

FIG. 3(*b*) is a transmission electron micrograph at 11,500X of tubes cold worked greater than 5% and annealed at 1075° K., of the present invention;

FIG. 4 is an average (0002) pole figure for seven tubes of the present invention.

In power reactors that use internally pressurized tubes two important mechanical property requirements are tensile strength and dimensional stability during service. Dimensional stability is a function of both creep and growth (dimensional change during irradiation without an applied stress). In zirconium tubes the ratio of creep in the axial and circumferential directions is a function of their crystallographic texture and the ratio of their growth in the axial and circumferential directions is a function of both crystallographic texture and the shape of the α grains. The crystallographic texture of extruded and cold drawn tubes is largely a function of the extrusion conditions—temperature, die shape, strain rate, billet microstructure and extrusion ratio (generally between 4:1 and 15:1). It has been found that the ratio of diametral expansion to axial elongation of a tube during service in a power reactor can be controlled by selecting the appropriate extrusion conditions.

The longitudinal tensile strength of 30% cold worked Zr-2.5 weight % Nb pressure tubes is due to their combination of high dislocation density, very small α grain thickness ($0.3\times10^{-3}$ mm) and a duplex microstructure of α grains and grain boundary network of β-phase. However, the in-reactor creep of of these tubes is adversely affected by their dislocation density and their in-reactor axial elongation due to growth is adversely affected by both their dislocation density and their very long elongated α grains ($0.3\times10^{-3}$ mm thick$\times$10 mm long). EXCEL is a stronger material than Zr-2.5 wt.% Nb. Therefore EXCEL tubes can be fabricated that are as strong or stronger than 30% cold worked Zr-2.5 wt.% Nb tubes, but have lower dislocation densities and/or more equiaxed α grains. These tubes have considerably better dimensional stability during service in power reactors.

Figure 3A:
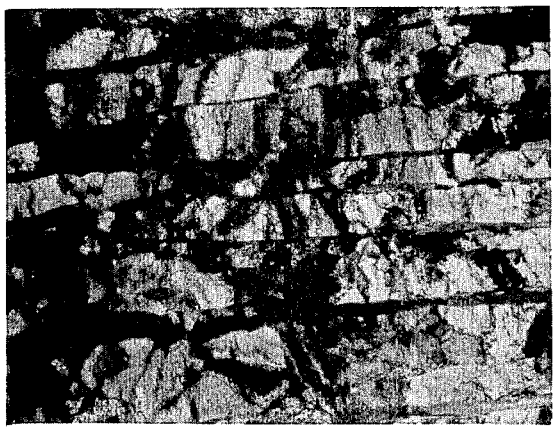
FIG. 3(*a*) is a transmission electron micrograph at 11,500X of extruded tubes cold worked less than 5% and stress relieved at 700° K., of the present invention.

The tensile strength of these EXCEL tubes is largely a function of their dislocation density and grain size. Tubes cold worked a minimum after extrusion and stress relieved will have thin elongated α grains (FIG. 3*a*). Their longitudinal tensile strengths can be up to 600 MPa at 575° K. depending on the stress relieving temperature. If the tubes are annealed after cold working to produce equiaxed recrystallized α grains (FIG. 3*b*) then the size of the grains depends on the amount of cold work and the annealing heat treatment.

Fabrication of Experimental Tubes

A double arc melted ingot of EXCEL alloy was forged to 215 mm diameter bar and machined to form seven hollow billets numbered 248–254. The billets were clad in steel and copper and preheated to about 1130° K. for approximately 5 hours and then extruded into tubes at a ratio of 13.5:1. The cladding was removed by dissolution in nitric acid, the inside of the tubes were sand blasted and the outside centerless ground. One end of each of the tubes was flame annealed, air cooled and pushed onto a die to point the end. A conversion coating was then applied and the tubes cold drawn between 2 and 5% as shown in Table 2. The chemical composition of the tubes is recorded in Table 1. The cold worked tubes were then sand blasted inside and centerless ground on the outside.

TABLE 1

The Chemical Analysis of the EXCEL Tubes

| Tube Number | Element: Sn wt % | Mo wt % | Nb wt % | O ppm | H ppm |
|---|---|---|---|---|---|
| 248 F | 3.32 | 0.81 | 0.83 | 1157 | 34 |
| 248 B | 3.08 | 0.77 | 0.79 | 1203 | 48 |
| 249 F | 3.31 | 0.81 | 0.80 | 1142 | 30 |
| 249 B | 3.29 | 0.82 | 0.81 | 1089 | 26 |
| 250 F | 3.23 | 0.79 | 0.82 | 1142 | 36 |
| 250 B | 3.31 | 0.82 | 0.82 | 1131 | 26 |
| 251 F | 3.32 | 0.79 | 0.83 | 1149 | 34 |

TABLE 1-continued

The Chemical Analysis of the EXCEL Tubes

| Tube Number | Element: Sn wt % | Mo wt % | Nb wt % | O ppm | H ppm |
|---|---|---|---|---|---|
| 251 B | 3.42 | 0.80 | 0.81 | 1134 | 28 |
| 252 F | 3.46 | 0.83 | 0.80 | 1142 | 29 |
| 252 B | 3.29 | 0.75 | 0.79 | 1119 | 25 |
| 253 F | 3.39 | 0.78 | 0.84 | 1149 | 32 |
| 253 B | 3.31 | 0.80 | 0.70 | 1116 | 18 |
| 254 F | 3.38 | 0.78 | 0.82 | 1118 | 54 |
| 254 B | 3.47 | 0.81 | 0.80 | 1115 | 34 |
| MEAN | 3.33 | 0.80 | 0.80 | 1136 | 34 |

F is the front end of the tube and comes out of the extrusion press first.
B is the back end of the tube and comes out of the extrusion press last.

TABLE 2

Extrusion and Cold Drawing Data for the EXCEL Pressure Tubes

| Billet Number | Total Furnace Preheat Time | Pressure to Start Extrusion psi | Length of Tube Extruded m | % Cold Draw |
|---|---|---|---|---|
| 248 | 5 hours 52 minutes | 1800 | 7.5 | 2.83 |
| 249 | 5 hours 56 minutes | 2000 | 5.8 | 3.71 |
| 250 | 6 hours 3 minutes | 1750 | 7.3 | 3.16 |
| 251 | 7 hours 22 minutes | 1700 | 7.5 | 2.77 |
| 252 | 7 hours 17 minutes | 1800 | 7.4 | 4.36 |
| 253 | 6 hours 48 minutes | 2300 | 4.3 | 2.90 |
| 254 | 7 hours 10 minutes | 1600 | 7.4 | 2.89 |

Two tubes, 249 and 251 were annealed in a vertical vacuum furnace for 30 minutes at 1023° K. to produce an equiaxed alpha grain structure. An equiaxed alpha grain structure should produce a lower in-reactor axial elongation rate at the expense of a slightly lower tensile strength.

Sections of tube 248 were cold worked up to 40% and then annealed for 30 minutes at a selected temperature in the range 1025°–1075° K.

All the tubes were finally stress relieved in an autoclave for 24 hours at 675° K.

The general fabrication route is shown in FIG. 1 and the particular steps for these seven tubes are shown in FIG. 2.

TABLE 3

α Grain Size and Dislocation Density of the EXCEL Pressure Tubes

| Tube Number | % Cold Drawn | Grain Size mm $\times 10^{-3}$: Front end | Back end | Aver. | Dislocation Density $m^{-2}$ |
|---|---|---|---|---|---|
| 250 | 3.7 | 0.75 | 0.48 | 0.62 | $8.4\times10^{14}$ |
| 252 | 3.2 | 0.81 | 0.46 | 0.64 | |
| 253 | 2.8 | 0.76 | 0.39 | 0.58 | |
| 254 | 4.4 | 0.70 | 0.54 | 0.62 | |
| Mean | | 0.76 | 0.51 | 0.64 | |
| 249 | 2.9 | | | 0.80 | $1.4\times10^{14}$ |
| 251 | 2.9 | | | 0.74 | |
| Cold worked Zr-2.5% Nb tubes | 30 | 0.4 | 0.2 | 0.3 | $5\text{–}9\times10^{14}$ |

PROPERTIES OF THE EXPERIMENTAL TUBES

Microstructure and Texture

Grain size and shape are important parameters in the tensile strength and in-reactor dimensional stability of zirconium alloy pressure tubes. The microstructures were examined by thin film electron microscopy. The results, FIG. 3*a* and Table 3, show that the microstructure of the cold worked tubes consists of elongated $\alpha$ grains, a thin grain boundary network of $\beta$-phase, and a few localized areas of martensitic $\alpha'$. The $\alpha$ grain thicknesses were larger than typical cold worked Zr-2.5% Nb pressure tubes, Table 3. The two annealed tubes, 249 and 251 had larger relatively equiaxed $\alpha$ grains, FIG. 3*b*, with the $\beta$-phase concentrated at grain corners. The five cold worked and stress relieved tubes had much higher average dislocation density than the annealed tubes, as seen in Table 3. The texture of the annealed and cold worked tubes was similar and an average (0002) pole figure for the seven tubes is shown in FIG. 4 and clearly indicates a predominance of basal plane normals in a radial transverse plane.

The effect of varying amounts of cold work and annealing temperature on the $\alpha$ grain thickness of an extruded tube is shown in Table 4 (below). The smallest grain thickness was obtained with 30% cold work followed by annealing for 30 minutes at 1025° K.

TABLE 4

The Effect of Cold Work and Annealing Heat Treatment on the Grain size of Extruded EXCEL Tube 248

| | Thickness of $\alpha$ Grain, mm $\times 10^{-3}$ | |
|---|---|---|
| % Cold Work | 30 minutes at 1025° K. | 30 minutes at 1075° K. |
| 0 | 0.80 | 0.80 |
| 5 | 0.79 | 1.08 |
| 10 | 0.72 | — |
| 20 | 0.59 | 0.98 |
| 30 | 0.53 | 0.97 |
| 40 | 1.11 | 1.72 |

Tensile Strength

The longitudinal and transverse tensile strengths of the tubes are shown in Table 5. The cold-worked and stress relieved tubes were considerably stronger than the annealed tubes due to their smaller grain thickness and higher dislocation density. The annealed tubes met the minimum specifications for 30% cold-worked Zr-2.5 wt% Nb pressure tubes.

Hydride Orientation

Figure 5:
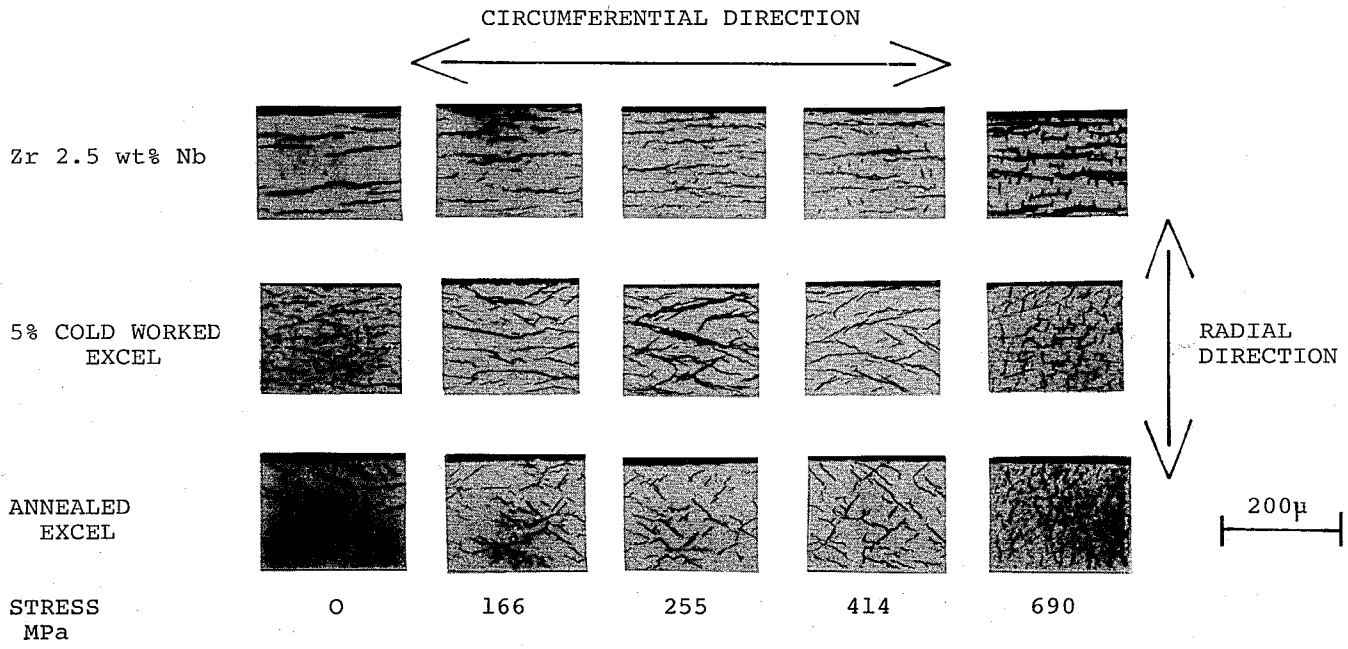
FIG. 5 is a series of optical micrographs showing the effect of stress on the orientation of zirconium hydrides in EXCEL and Zr-2.5 wt.% Nb tubes.

As fabricated the hydrides were oriented in the radial-axial plane. The effect of hoop stress on the orientation of the hydrides that precipitate during cooling from 575° K. is shown in FIG. 5. To precipitate hydrides in the radial-axial plane required a hoop stress of 827 MPa.

TABLE 5

Tensile Properties of the EXCEL Pressure Tubes and Typical Tensile Properties of 30% Cold-Worked Zr-2.5% Nb Pressure Tubes

| Alloy | Tube Condition | Test Temperature °K. | Test Direction | 0.2% Yield Stress MPa | UTS MPa | % Elongation |
|---|---|---|---|---|---|---|
| EXCEL | 5% cold drawn | 575 | L | 525 | 580 | 12 |
| | | | T | 620 | 645 | 13 |
| | | 300 | L | 736 | 845 | 12 |
| | | | T | 930 | 965 | 9 |
| | annealed | 575 | L | 385 | 500 | 19 |
| | | | T | 490 | 555 | 13 |
| | | 300 | L | 615 | 745 | 17 |
| | | | T | 815 | 840 | 17 |
| Zr-2.5% Nb | 30% cold drawn | 575 | L | 380 | 520 | 15 |
| | | | T | 540 | 600 | 12 |
| | | 300 | L | 640 | 790 | 13 |
| | | | T | — | 810 | 15 |

L is longitudinal
T is transverse

COMPARISON WITH STANDARD Zr-2.5% Nb ALLOY PRESSURE TUBES

Tensile Strength

Cold worked Zr-2.5% Nb is the reference pressure tube material for CANDU-PHW reactors. EXCEL alloys having chemical compositions in the range 2.5–4.0% Sn, 0.5–1.5% Mo, 0.5–1.5% Nb, 800–1300 ppm O, balance Zr plus incidental impurities, have been found to have higher strengths than the Zr-2.5% Nb alloys and good in-reactor creep resistance.

In all metallurgical conditions EXCEL alloys are stronger than Zr-2.5% Nb but when heat treated to produce the required high strengths for use in a reactor the ductility is relatively low as shown in Table 6.

TABLE 6

Typical Tensile Properties of Zr-2.5% Nb and EXCEL alloy at 575° K.

| | | 0.2% YS | | UTS | | Total |
|---|---|---|---|---|---|---|
| Alloy | Condition | MPa | K psi | MPa | K psi | Elongation |
| Zr-2.5% Nb | Annealed | 207 | 30 | 280 | 40 | 30 |
| EXCEL | Annealed | 338 | 40 | 460 | 65 | 20 |
| Zr-2.5% Nb | 20% cold worked | 365 | 53 | 406 | 59 | 11 |
| EXCEL | 20% cold worked | 517 | 75 | 579 | 84 | 11 |
| Zr-2.5% Nb | Heat treated | 579 | 84 | 644 | 935 | 15 |
| EXCEL | Heat treated | 620 | 115 | 860 | 130 | 5 |

Typical tensile properties of cold worked Zr-2.5% Nb pressure tubes and EXCEL pressure tubes in the extruded condition and also cold drawn about 3%, 10%, and 15% are shown below in Table 7.

TABLE 7

Typical Tensile Properties of Cold Worked Zr 2.5% Nb and EXCEL Alloy Pressure Tubes at 575° K.

| | | Test Direction | 0.2% Yield Stress | | UTS | | | |
|---|---|---|---|---|---|---|---|---|
| Alloy | Condition | | Kpsi | MPa | Kpsi | MPa | % EL | % RA |
| Zr-2.5% Nb | extruded and cold drawn 28% | L | 50 | 379 | 71 | 489 | 18 | 50 |
| | | T | 79 | 544 | 88 | 606 | 12 | 75 |
| EXCEL Alloy | extruded | L | 58 | 400 | 75 | 517 | 15 | 47 |
| | extruded and cold drawn <3% | L | 60 | 413 | 83 | 572 | 14 | 48 |
| | | T | — | | 99 | 682 | — | 60 |

TABLE 7-continued

| Typical Tensile Properties of Cold Worked Zr 2.5% Nb and EXCEL Alloy Pressure Tubes at 575° K. | | | | | | | | |
|---|---|---|---|---|---|---|---|---|
| | | Test Direction | 0.2% Yield Stress | | UTS | | | |
| Alloy | Condition | | Kpsi | MPa | Kpsi | MPa | % EL | % RA |
| | extruded and cold drawn ~10% | L | 73 | 503 | 87 | 599 | 15 | 46 |
| | | T | — | | 90 | 620 | — | 59 |
| | extruded and cold drawn 15% | L | 75 | 517 | 90 | 620 | 13 | 40 |
| | | T | — | | 96 | 661 | — | 58 |

L is longitudinal
T is transverse

EXCEL alloy tubes in the extruded condition are shown to be stronger than conventional 30% cold drawn Zr-2.5% Nb tubes but cold drawing of the EXCEL tubes 15% does not increase their strength very much.

Pressure Tube Safety

The design stress of reactor pressure tubes is only one third of the minimum ultimate tensile strength in the unirradiated condition at the design temperature so that it is inconceivable for failure to occur by tensile rupture, in view of the pressure warning and relief systems in a power reactor. If the pressure tube should sustain a defect of sufficient severity, however, its rupture strength will be reduced to the level of the design or operating stress, and the tube would break. The most severe defect is a sharp longitudinal through wall crack, because the maximum (hoop) tensile stress acts to open and extend the crack. An important parameter in the ability of tubes to tolerate longitudinal defects is the presence of zirconium hydrides. The tolerance of pressure tubes to such defects depends on such factors as neutron irradiation, test temperature and hydrogen concentration. Test results show both Zr-2.5% Nb and EXCEL tubes have similar tolerances with respect to neutron irradiation, test temperature, and hydrogen concentration although the effects of hydrogen will be described in more detail hereinafter. Normally it is expected that pressure tube alloys will fracture in a completely ductile manner with large local plasticity and that a tube will leak coolant before it actually breaks.

CANDU-PHW reactors are normally operated with a reducing coolant chemistry which is maintained by adding hydrogen to the water. During service the pressure tubes corrode in the heavy water coolant and some of the deuterium is picked up by the tube. Hydrogen and deuterium have a very low solubility in zirconium alloys and form zirconium hydride or zirconium deuteride platelets which are brittle. As-fabricated pressure tubes only contain 10–15 ppm hydrogen and no hydride platelets are present at reactor operating temperatures (530°–575° K.). However towards the end of their service life (≧15 years) they are predicted to contain 30–50 ppm hydrogen (60–100 ppm deuterium) and hydride platelets could be present at the operating temperatures. The orientation of the hydride platelets is a function of crystallographic texture and stress. Although EXCEL alloys tend to corrode marginally faster under these conditions than do Zr-2.5% Nb alloys, the hydrogen pick-up (hydriding) rate is about the same.

Hydrogen pick-up is particularly significant because it is known that failures, due to delayed hydrogen cracking, can occur at stresses below the ultimate tensile strength of the alloy if such stresses are present for long periods of time as would be the case in-reactor. Crack propagation is quite slow and the fracture surfaces are characterized by areas of flat cleavage compared to the dimpled surface of a ductile fracture. These flat fracture areas corresponding to failure either through hydride platelets or at the hydride/matrix interface. For delayed hydrogen cracking to occur, hydrogen concentration in the alloy must exceed the terminal solid solubility at the test/operating temperature. Important parameters for crack initiation and propagation include (*a*) stress or stress intensity at a notch; (*b*) hydrogen concentration and hydride orientation and (*c*) temperature.

Crack initiation at the inside surface of cold worked Zr-2.5% Nb pressure tubes has been studied using cantilever beam specimens. Specimens from the transverse direction were loaded in cantilever beam test rigs so that the maximum outer fiber tensile stress was imposed on the inside surface of the tube in the circumferential direction. The test results, Table 8, show that the probability of crack initiation increases with stress and at 350° K. also increases with hydrogen concentration. Similar tests have been performed on EXCEL alloys and the results, summarized in Table 9, show that crack initiation by delayed hydrogen cracking is more difficult to initiate in EXCEL pressure tubes than in Zr-2.5% Nb pressure tubes.

TABLE 8

| SUMMARY OF THE CANTILEVER BEAM TEST RESULTS ON COLD-WORKED Zr-2.5 wt % Nb | | | | | |
|---|---|---|---|---|---|
| Test Temperature K. | Hydrogen Concentration ppm | Maximum* Stress MPa | Range of Failure Times for Failed Specimens, h | Test Times for Specimens Still on Test, 1.10.77, h | Probability of Failing |
| 350 | 10–15 | 620 | 1350–9963 (15) | 10,670–13,264 (28) | 0.35 |
| | 10–15 | 585 | no failures in 11,000 (2)# | | 0 |
| | 10–15 | 550 | no failures | 16,549–17,365 (7) | 0 |
| | 40–120 | 620 | 53–1816 (5) | all failed | 1 |
| | 40–120 | 585 | 276–965 (4) | 10,673 (1)# | 0.8 |
| | 40–120 | 550 | 9850 (1) | 8,620–10,767 (5) | 0.2 |
| | | | NO FAILURES BELOW 550 MPa | | |
| | 25–40 | 482+ | (5,516–5,632) (2) | 5,580 (17) | |

TABLE 8-continued

SUMMARY OF THE CANTILEVER BEAM TEST RESULTS ON COLD-WORKED Zr-2.5 wt % Nb

| Test Temperature K. | Hydrogen Concentration ppm | Maximum* Stress MPa | Range of Failure Times for Failed Specimens, h | Test Times for Specimens Still on Test, 1.10.77, h | Probability of Failing |
|---|---|---|---|---|---|
| | 25–40 | 344+ | no failures | 5,580 (17) | |
| 425 | 40–120 | 620 | 2–1705 (6) | 8244 (2)# | 0.75 |
| | 40–120 | 585 | 136–1728 (11) | 8000 (5)# | 0.7 |
| | 40–120 | 550 | 500–8500 (4) | 11,305 (11)≠ | 0.15 |
| | 40–120 | 413 | 1900–7135 (2) | 11,305 (6)≠ | 0.05 |
| | 40–120 | 276 | no failures | 10,174 (14)# | 0 |
| 525 | 40–120 | 620 | 696–6904 (8) | all failed | 1.0 |
| | 40–120 | 585 | 700–6760 (2) | 6,900–9,692 (5)≠ | 0.29 |
| | 40–120 | 550 | no failures | 9692 (4)≠ | 0 |
| | | | NO FAILURES BELOW 585 MPa | | |

*Maximum outer fibre stress after a thermal cycle to 575 K.
( ) Number of specimens.
+These specimens have scratches 0.002–0.004 in. (0.05–0.1 mm) deep on the inside surface of the tube perpendicular to the stress.
#Tests discontinued and specimens examined.
≠Some tests discontinued and specimens examined.

TABLE 9

SUMMARY OF CANTILEVER BEAM TESTS ON XL ALLOY

| Test Temperature K. | Material Condition | Hydrogen Content ppm | Surface Condition | Maximum Stress* MPa | Range of Failure times, h | Test Times for Specimens on test 1.12.77, h |
|---|---|---|---|---|---|---|
| 350 | as extruded | AR | 0.6 mm scratch | 620 | no failures | 7576 (2) |
| | cold worked | AR | 0.6 mm scratch | 620 | 4500 (1) | — |
| | cold worked | AR | AR | 620 | no failures | 10,717, 11,123 (2) |
| | cold worked | AR | EDM notched | 550 | no failures | 10,219, 10,576 (2) |
| 425 | as extruded | 40–60 | AR | 620 | no failures | 1825 (5) |
| | as extruded | 40–60 | AR | 585 | no failures | 1799 (4) |
| 525 | as extruded | 40–60 | AR | 620 | no failures | 366 (4) |
| | as extruded | 40–60 | AR | 585 | no failures | 366 (4) |
| | as extruded | 40–60 | AR | 550 | no failures | 366 (4) |

*Maximum outer fiber stress after thermal cycle to 575 K.
( ) Number of specimens.
AR is as received.

In cold worked Zr-2.5% Nb and EXCEL alloy pressure tube materials the hydrides in unstressed material lie in circumferential planes, and have very little effect on the tolerance of the tubes to longitudinal defects. However if the hydrides precipitate under a hoop stress as during a reactor shut down, above a critical stress the hydrides precipitate in the radial-axial plane and severely reduce the tolerance of the tubes to longitudinal defects. When the Zr-2.5% Nb material is thermally cycled to 575° K. under a circumferential tensile stress, then some of the hydrides become reoriented to the radial plane. As the zirconium hydrides are less ductile than $\alpha$ zirconium, hydrides perpendicular to a tensile stress lower the ductility. It will be noted that even relatively low stress levels of the order of 200 MPa causes reorientation of most of the hydrides into the radial axial plane. The results of thermally cycling EXCEL alloys to 575° K. at similar stress levels are also shown and it will be observed that the hydrides in the EXCEL tubes are very much more resistant to reorienting in the radial direction, which is a very desirable property. Therefore EXCEL tubes should be more tolerant to longitudinal defects than Zr-2.5% Nb tubes.

Figure 3B:
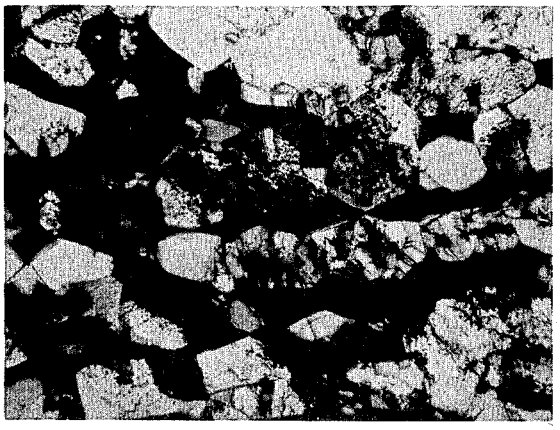

In summary, therefore, the axial elongation and diametral expansion of current 30% cold worked Zr-2.5% Nb pressure tubes could be reduced by lowering their dislocation density and making their grains more equiaxed. This would, however, also lower the tensile strength below specifications. EXCEL alloys are stronger and more creep resistant than Zr-2.5% Nb. This enables EXCEL pressure tubes to be made that have similar strength to 30% cold worked Zr-2.5% Nb tubes yet only be cold worked <5%. This dislocation density of EXCEL alloys can be further lowered by annealing to produce a more equiaxed grain structure as shown in FIG. 3*b*. The predicted dimensional changes for EXCEL tubes after 30 years service in a CANDU-PHW 600 MW reactor are shown in Table 10. The 5% cold-worked tubes were much stronger than the current requirements for CANDU-PHW reactors (minimum longitudinal UTS at 575° K., 479 MPa). If these tubes were stress relieved at a higher temperature to reduce their longitudinal strength at 575° K. to 500 MPa, then their dimensional changes would be much less as shown in Table 10. Similarly, if the extrusion ratio used for these tubes was reduced from 13.5:1 to 11:1 then the texture would be changed and the axial elongation could be further reduced.

TABLE 10

Predicted Dimensional Performance of the EXCEL Pressure Tubes in 600 MW CANDU-PHW Reactors

| Alloy | Tube Type | Dimensional Change for Central Channel after 30 Years: Axial Elongation | % Diametral Expansion |
|---|---|---|---|
| EXCEL | extruded 13.5:1 5% cold worked stress relieved 675° K. | 2.2 | 1.8 |
| | extruded 13.5:1 5% cold worked stress relieved >700° K. | 1.4 | 2.2 |
| | extruded 11:1 5% cold worked stress relieved >700° K. | 1.0 | 2.0 |

TABLE 10-continued

Predicted Dimensional Performance of the EXCEL Pressure Tubes in 600 MW CANDU-PHW Reactors

| Alloy | Tube Type | Dimensional Change for Central Channel after 30 Years | |
|---|---|---|---|
| | | Axial Elongation | % Diametral Expansion |
| | extruded 13.5:1, cold worked, annealed | 0.8 | 1.1 |
| | extruded at 11:1 cold worked, annealed | 0.5 | 1.4 |
| Zr-2.5% Nb | 30% cold worked | 2.5 | 3.9 |

We claim:

1. A method of fabricating an extruded product from an alloy consisting essentially of Sn 2.5–4%, Mo 0.5–1.5%, Nb 0.5–1.5%, 0 800–1300 ppm, balance Zr and incidental impurities wherein a billet of said alloy is preheated in the temperature range 900°–1200° K. and extruded into said product at an extrusion ratio between 4:1 and 15:1 and said extruded product is cold worked by a selected amount of less than 5% and stress relieved at a selected temperature in the range 650°–800° K., the amount of cold working and heat treatment temperature being selected so as to produce a product having a fine grain size, a crystallographic texture with a predominance of basal plane normals in the radial transverse plane, a dislocation density of less than about $5\times10^{14}$ $m^{-2}$ a minimum U.T.S. of 479 PMa, a maximum axial elongation less than 1.5% and a maximum diametral expansion less than 2.5% under conditions equivalent to 30 years service in a CANDU-PHW 600 MW reactor.

2. A method of fabricating an extruded product from an alloy consisting essentially of Sn 2.5–4%, Mo 0.5–1.5%, Nb 0.5–1.5%, 0 800–1300 ppm, balance Zr and incidental impurities wherein a billet of said alloy is preheated in the temperature range 900°–1200° K. and extruded into said product at an extrusion ratio between 4:1 and 15:1 and said extruded product is cold worked 10–40% and annealed at a selected temperature in the range 950°–1100° K., the amount of cold working and heat treatment temperature being selected so as to produce a product having a fine grain size, a crystallographic texture with a predominance of basal plane normals in the radial transverse plane, a dislocation density of less than about $5\times10^{14}$ $m^{-2}$ a minimum U.T.S. of 479 PMa, a maximum axial elongation less than 1.5% and a maximum diametral expansion less than 2.5% under conditions equivalent to 30 years service in a CANDU-PHW 600 MW reactor.

3. A method of fabricating an extruded alloy product as claimed in claim 1 wherein said stress relieving temperature is selected so as to provide a product having an in-service axial elongation in the range 1.0–1.4% and an in-service diametral expansion in the range 1.8–2.2%.

4. A method of fabricating an extruded alloy product as claimed in claim 2, wherein said cold working and said annealing temperature are selected to produce a product having an in-service axial elongation of in the range 0.5–0.8% an in-service diametral expansion in the range 1.1–1.4% and an equiaxed grain structure.

5. A method of fabricating an extruded alloy product as claimed in claim 1 or 2 wherein said cold working step comprises cold drawing.

6. A method of fabricating an extruded alloy product as claimed in claim 2 wherein said annealing is effected at about 1023° K. for about 30 minutes.

* * * * *